US009162278B2

(12) United States Patent
Ko

(10) Patent No.: US 9,162,278 B2
(45) Date of Patent: Oct. 20, 2015

(54) HAND-HELD RIVET NUT TOOL WITH A REPLACEABLE MANDREL-DRIVING DEVICE

(71) Applicant: Karat Industrial Corporation, New Taipei (TW)

(72) Inventor: Philey Ko, New Taipei (TW)

(73) Assignee: Karat Industrial Corporation, New Taipei (TW)

( * ) Notice: Subject to any disclaimer, the term of this patent is extended or adjusted under 35 U.S.C. 154(b) by 0 days.

(21) Appl. No.: 14/277,878

(22) Filed: May 15, 2014

(65) Prior Publication Data

US 2014/0345099 A1 Nov. 27, 2014

(30) Foreign Application Priority Data

May 22, 2013 (TW) ..... 102117980 A

(51) Int. Cl.
*B21J 15/04* (2006.01)
*B21J 15/38* (2006.01)
*B25B 27/00* (2006.01)

(52) U.S. Cl.
CPC ..... *B21J 15/383* (2013.01); *B21J 15/043* (2013.01); *B21J 15/045* (2013.01); *B21J 15/386* (2013.01); *B25B 27/0007* (2013.01); *Y10T 29/53757* (2015.01)

(58) Field of Classification Search
CPC ..... B21J 15/386; B21J 15/043; B21J 15/045; B25B 27/0007
USPC ..... 29/243.527
See application file for complete search history.

(56) References Cited

U.S. PATENT DOCUMENTS

| | | | | |
|---|---|---|---|---|
| 3,548,627 | A * | 12/1970 | Henshaw | 29/243.527 |
| 5,079,818 | A * | 1/1992 | Schwab | 29/243.527 |
| 5,359,762 | A * | 11/1994 | Liu | 29/243.527 |
| 5,771,738 | A | 6/1998 | Ko | |
| 6,029,332 | A * | 2/2000 | Schruff | 29/243.527 |
| 6,912,763 | B2 * | 7/2005 | Kovar | 29/243.527 |
| 7,051,411 | B2 * | 5/2006 | Liu | 29/243.527 |
| 7,146,698 | B2 * | 12/2006 | Kovar | 29/243.527 |
| 9,003,621 | B2 * | 4/2015 | Ko | 29/243.527 |

FOREIGN PATENT DOCUMENTS

TW 316504 12/1997

* cited by examiner

*Primary Examiner* — David B Jones
(74) *Attorney, Agent, or Firm* — Alan D. Kamrath; Kamrath IP Lawfirm, P.A.

(57) ABSTRACT

A hand-held rivet nut tool has a body having a base; two handles connected pivotally to the base; two pairs of links connected pivotally and respectively to the handles; a driven member connected pivotally to the pairs of the links; and a mandrel mounted rotatably through the driven member and the base. A push-and-pull mandrel-driving device or a rotational mandrel-driving device is mounted detachably and hence replaceably on the driven member, and is capable of driving the mandrel, the bushing and the threaded shaft. A user is allowed to choose either the push-and-pull mandrel-driving device or the rotational mandrel-driving device according to different working spaces or personal practices.

18 Claims, 12 Drawing Sheets

HAND-HELD RIVET NUT TOOL WITH A REPLACEABLE MANDREL-DRIVING DEVICE

BACKGROUND OF THE INVENTION

1. Field of the Invention

The present invention relates to a rivet nut tool and, more particularly, to a hand-held rivet nut tool with a replaceable mandrel-driving device that allows replacing a mandrel-driving device on the hand-held rivet nut tool.

2. Description of Related Art

A rivet nut tool is used for mounting a rivet nut on a work piece. With reference to FIG. 12, Taiwan Patent No. 316504 discloses a rivet nut tool with a fixing hole that comprises a body 40 having a base 41 with two handles 42 mounted pivotally and respectively on two sides of the base 41. The handles 42 are mounted pivotally on a driven member 44 respectively through two links 43. A mandrel (not shown on FIG. 12) extends through the driven member 44 and has an external threaded shaft 45 mounted on a head end of the mandrel. A push-and-pull mandrel-driving device 50 is mounted on a tail end of the mandrel and has a mounting tube 51 and a spiral pushing rod 52 mounted in the mounting tube 51. When the rivet nut tool is used, the handles 42 are unfolded to drive the links 43, the driven member 44 and the mandrel, so that the external threaded shaft 45 of the mandrel extends out of a top of the base 41. Then, the spiral pushing rod 52 is firstly pulled and then pushed to rotate the mandrel to screw the external threaded shaft 45 on the head end of the mandrel into a rivet nut 46 that is to be riveted. Further, the handles 42 are folded to drive the mandrel to move along a direction away from the base 41. The moving mandrel drives the external threaded shaft 45 to squeeze and deform the rivet nut 46, so that the rivet nut 46 is riveted on the work piece. Finally, the spiral pushing rod 52 is pulled to remove the external threaded shaft 45 out of the fastened rivet nut 46.

Although the aforementioned push-and-pull mandrel-driving device 50 allows a user to easily and quickly rotate the spiral pushing rod 52 to screw the external threaded shaft 45 into or out of the rivet nut 46, the user can operate the push-and-pull mandrel-driving device 50 only in a sufficient large working space allowing the spiral pushing rod 52 to be pulled and extended to accomplish the riveting process of the rivet nut 46 on the work piece. If the riveting process is executed in a narrow working space, the spiral pushing rod 52 cannot completely extend out due to insufficient working space and therefore cannot accomplish the process for riveting the rivet nut 46 on the work piece. Furthermore, the push-and-pull mandrel-driving device 50 is mounted securely on the body 40 and is not adjustable according to different working spaces, so that using the rivet nut tool in a narrow working space requires a different type of rivet nut tool (for example, a rivet nut tool with a rotational mandrel-driving device).

To overcome the shortcomings, the present invention provides a hand-held rivet nut tool with a replaceable mandrel-driving device to mitigate or obviate the aforementioned problems.

SUMMARY OF THE INVENTION

The main objective of the invention is to provide a hand-held rivet nut tool with a replaceable mandrel-driving device that allows replacing a mandrel-driving device on the hand-held rivet nut tool.

A hand-held rivet nut tool in accordance with the present invention comprises a body having a base; two handles connected pivotally to the base; two pairs of links connected pivotally and respectively to the handles; a driven member connected pivotally to the pairs of the links; and a mandrel mounted rotatably through the driven member and the base. A push-and-pull mandrel-driving device or a rotational mandrel-driving device is mounted detachably and hence replaceably on the driven member, and is capable of driving the mandrel, the bushing and the threaded shaft. A user is allowed to choose either the push-and-pull mandrel-driving device or the rotational mandrel-driving device according to different working spaces or personal practices.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
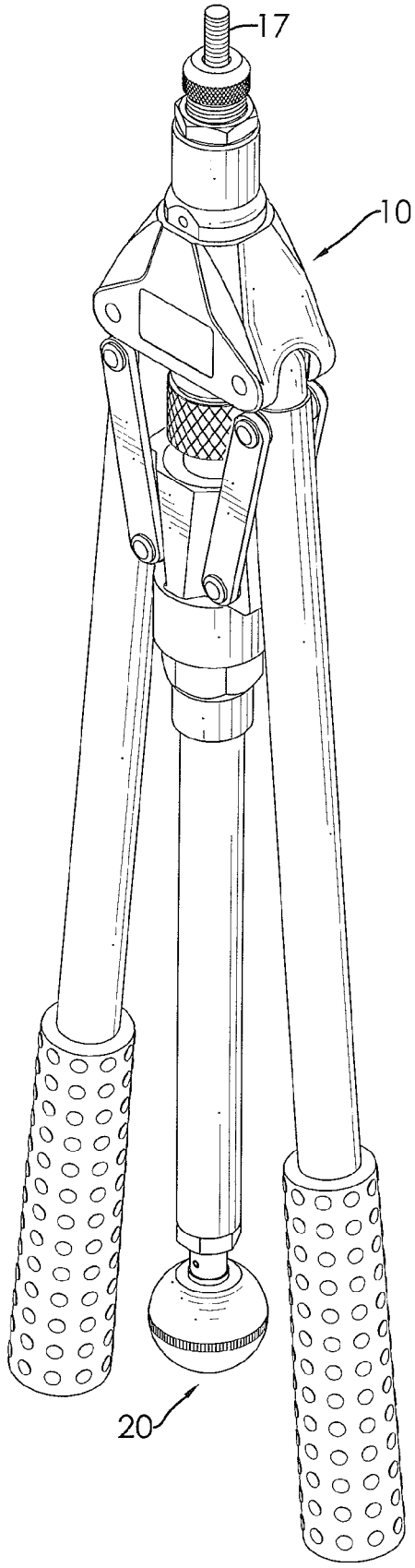
FIG. 1 is a perspective view of a first embodiment of a hand-held rivet nut tool with a replaceable mandrel-driving device in accordance with the present invention.

With reference to FIG. 1, a first embodiment of a hand-held rivet nut tool in accordance with the present invention comprises a body 10 and a push-and-pull mandrel-driving device 20.

With further reference to FIGS. 2 to 5, the body 10 has a base 11, two handles 12, two pairs of links 13, a driven member 14, a mandrel 15, a bushing 16 and a threaded shaft 17, 17A.

The base 11 has a through hole 111 defined through the base 11.

The handles 12 are connected pivotally and respectively to two opposite sides of the base 11.

The pairs of the links 13 are connected pivotally and respectively to the handles 12.

The driven member 14 is connected pivotally to the pairs of the links 13, is located under the base 11 and has an aperture 141 defined through the driven member 14. The aperture 141 corresponds to the through hole 111 of the base 11 and has an internal thread 142 formed on an inner surface of the aperture 141 adjacent to a tail end 148 of the driven member 14.

The mandrel 15 is mounted rotatably through the aperture 141 of the driven member 14 and the through hole 111 of the base 11 and has an external thread 151 formed on an outer surface of the mandrel 15. Preferably, the mandrel 15 further has a recess 152 being polygonal and defined in a tail end 158 end of the mandrel 15.

The bushing 16 is mounted on a head end 157 end of the mandrel 15 and has an internal lower thread 161 and an internal upper thread 162. The internal lower thread 161 is formed on a tail end 168 end of the bushing 16 and engages the external thread 151 of the mandrel 15. The internal upper thread 162 is formed on a head end 167 end of the bushing 16.

The threaded shaft 17, 17A may be a male threaded shaft 17 or a female threaded shaft 17A, is mounted on the head end 178 of the bushing 16 and has an external threaded portion 171, 171A, and an adapter portion. The external threaded portion 171, 171A is formed on a tail end 178 end of the threaded shaft 17, 17A and engages the internal upper thread 162 of the bushing 16. The adapter portion is formed on a head end 177 end of the threaded shaft 17, 17A and may be an external thread or an internal thread for screwing on a rivet nut 18 or a rivet bolt 18A. Furthermore, the threaded shaft 17, 17A can be replaced with another one having a differently sized adapter portion for a different size of rivet nuts 18 or rivet bolts 18A.

Figure 2:
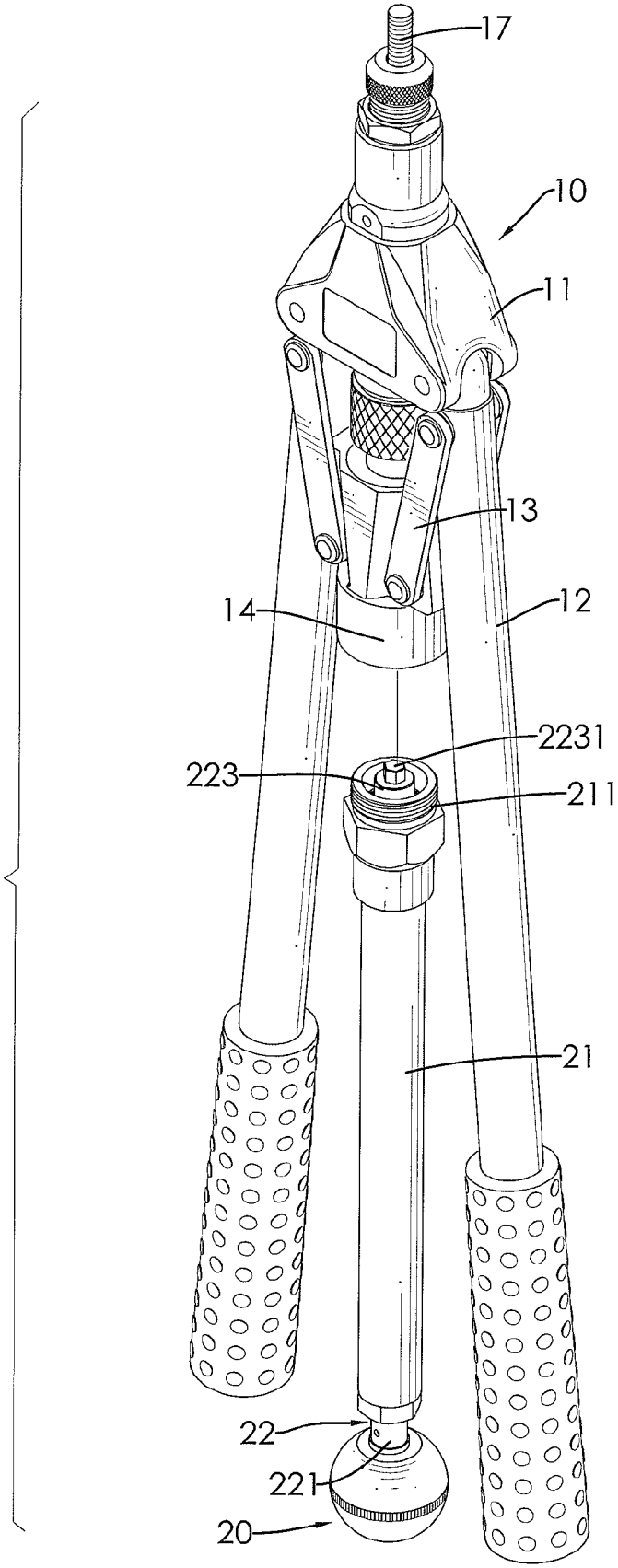
FIG. 2 is a partially exploded perspective view of the hand-held rivet nut tool in FIG. 1.
Figure 3:
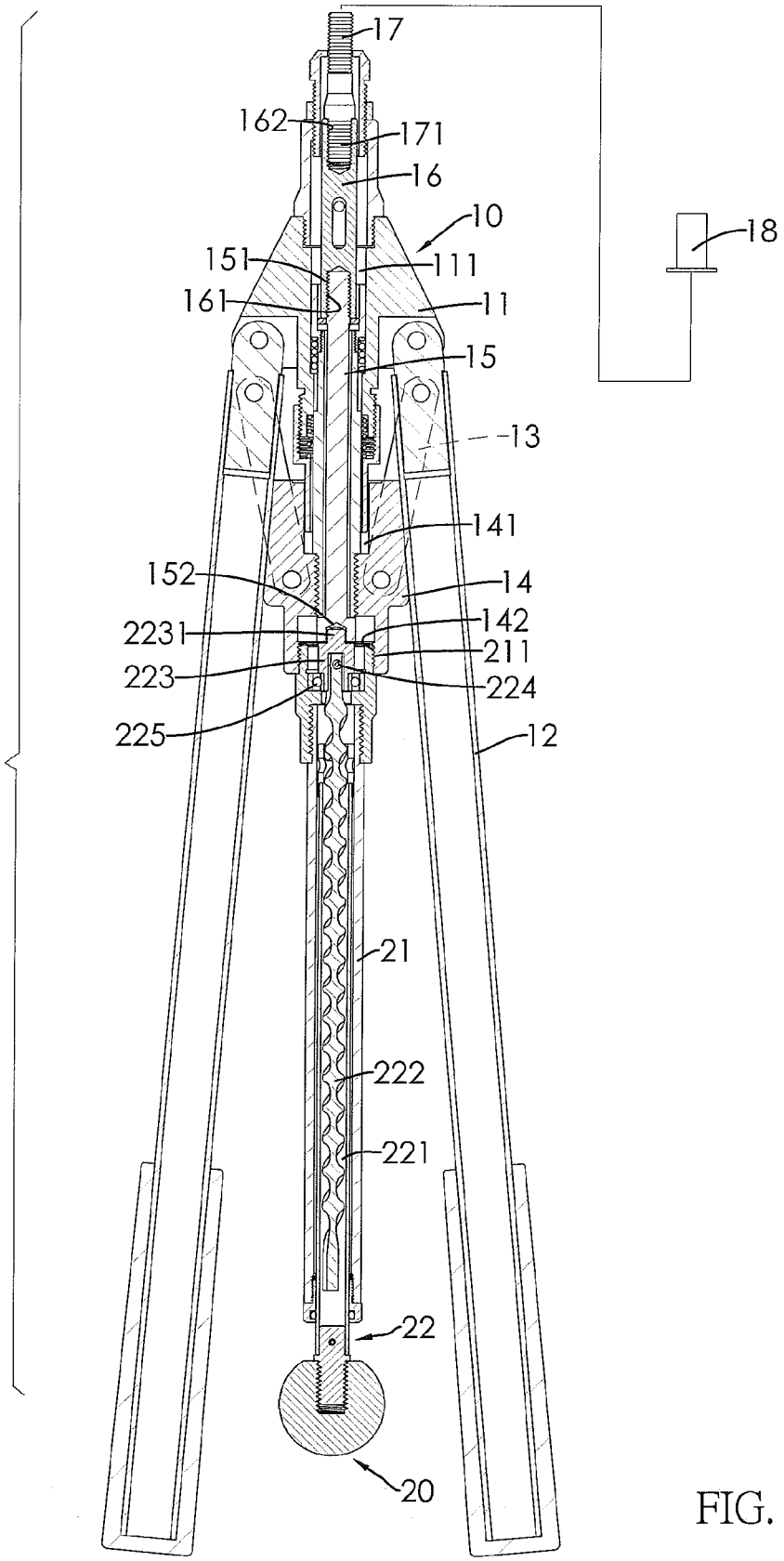
FIG. 3 is a cross sectional side view of the hand-held rivet nut tool in FIG. 1 with a male threaded shaft corresponding to a rivet nut.

The embodiment as shown in FIGS. 1 to 3 is a rivet nut tool having the male threaded shaft 17 screwed on a rivet nut 18. The embodiment as shown in FIG. 4 is a rivet bolt tool having the female threaded shaft 17A screwed on a rivet bolt 18A.

Figure 4:
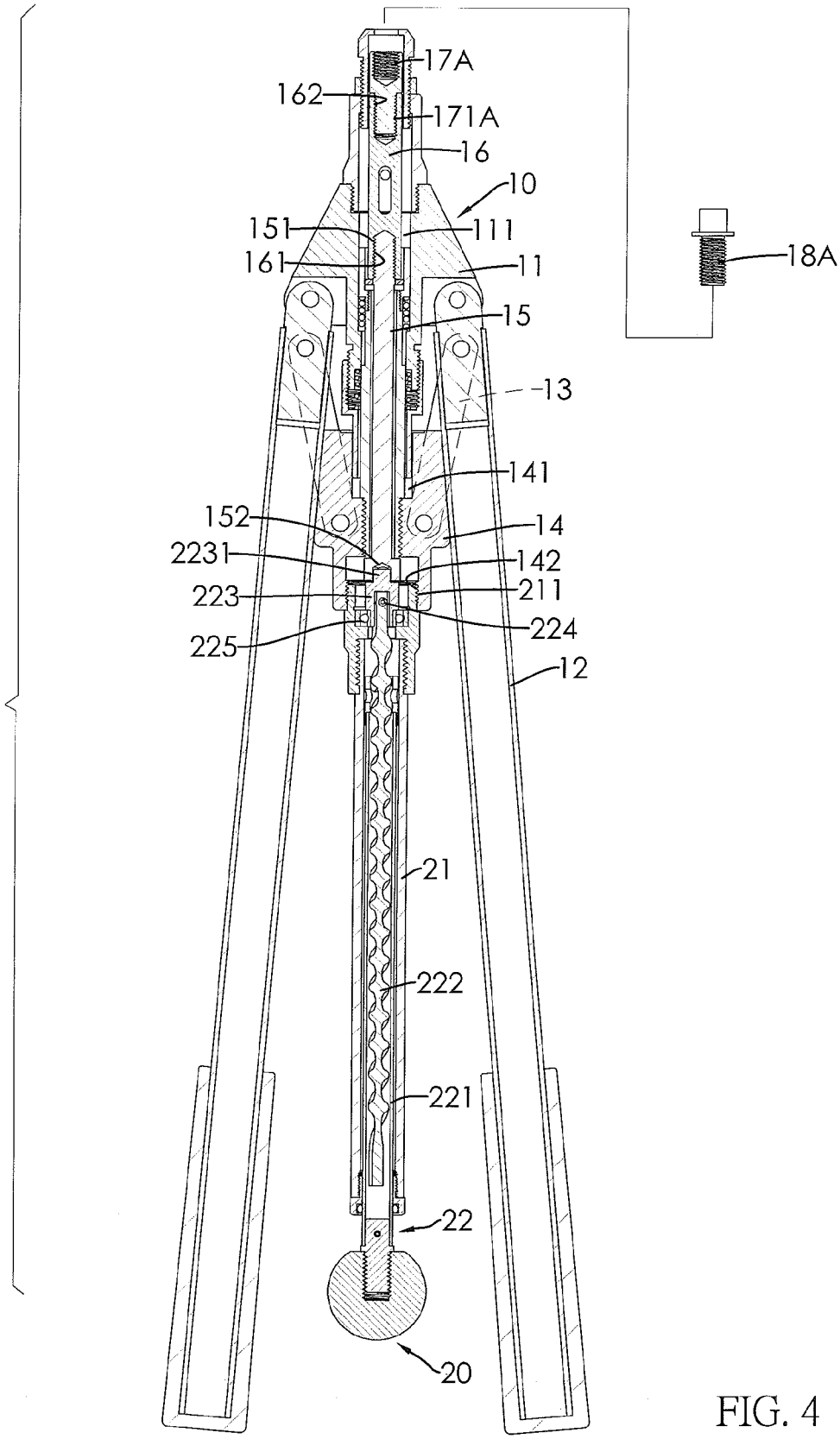
FIG. 4 is a cross sectional side view of the hand-held rivet nut tool in FIG. 1 with a female threaded shaft corresponding to a rivet bolt.
Figure 5:
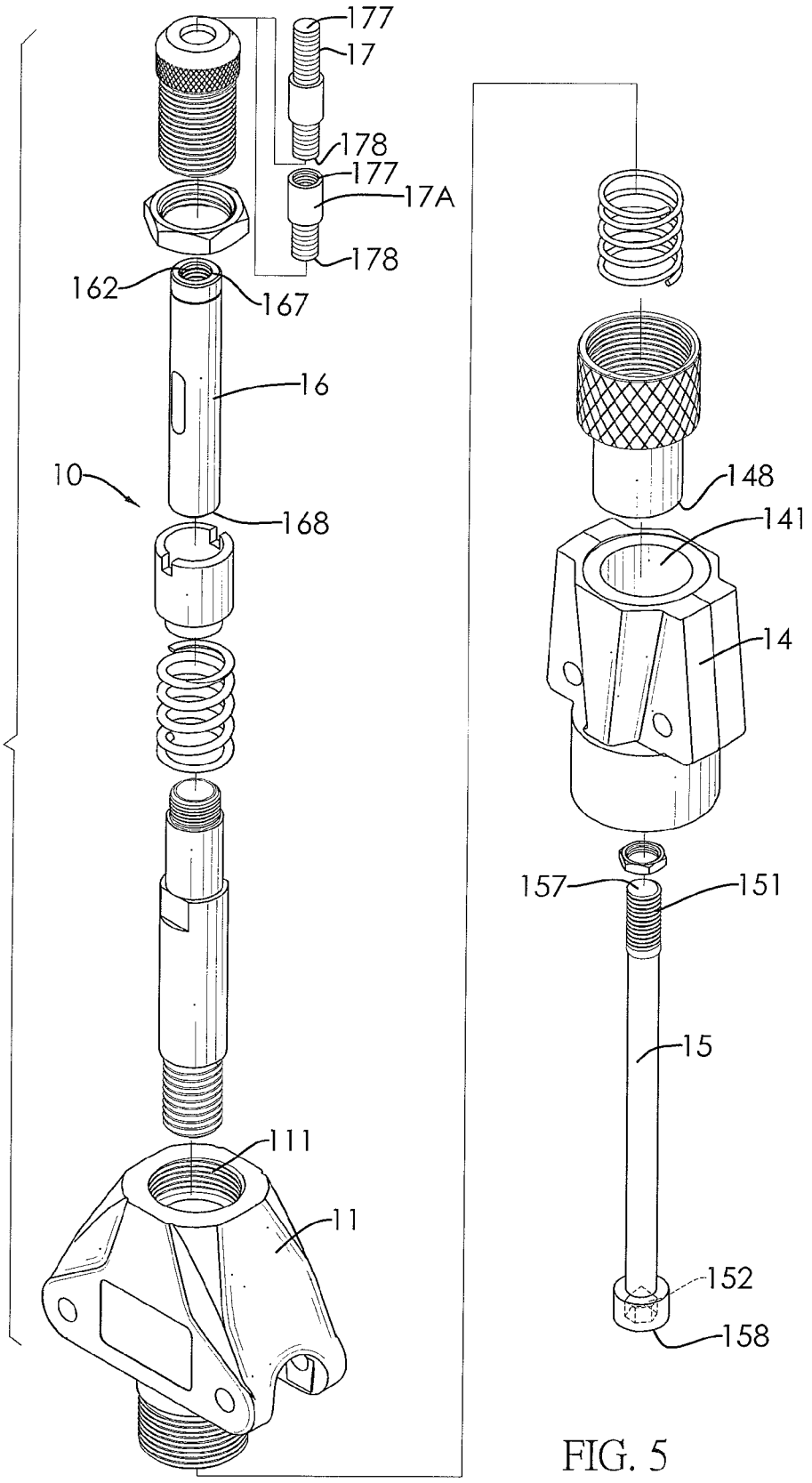
FIG. 5 is an exploded perspective view of the hand-held rivet nut tool in FIG. 1 omitting a push-and-pull mandrel-driving device.
Figure 6:
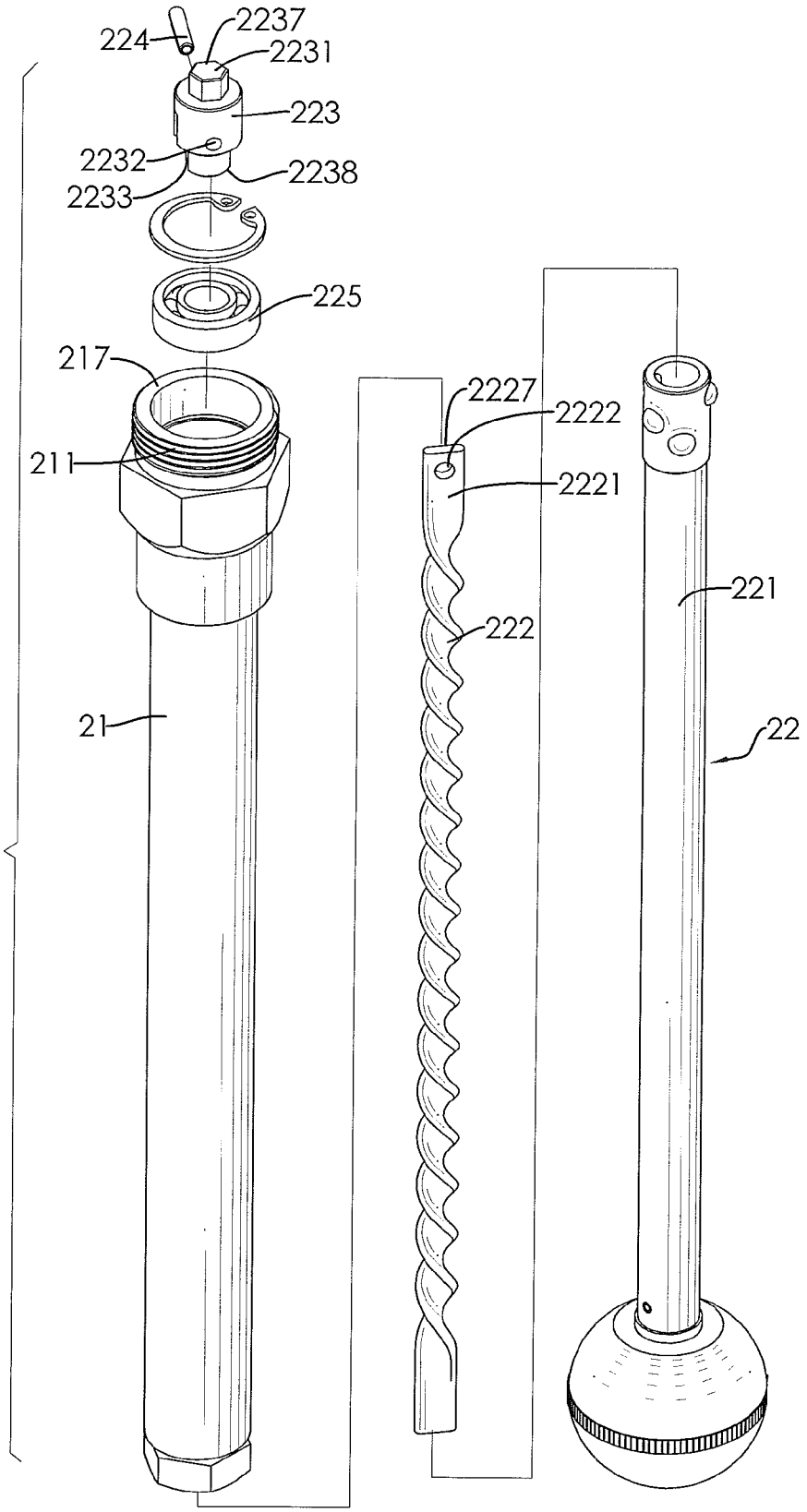
FIG. 6 is an exploded perspective view of the push-and-pull mandrel-driving device of the hand-held rivet nut tool in FIG. 1.

With reference to FIGS. 3, 4 and 6, the push-and-pull mandrel-driving device 20 is mounted detachably on the driven member 14 and has a mounting tube 21 and a spiral pushing rod assembly 22.

The mounting tube 21 is hollow, is mounted detachably on the driven member 14 and has an outer thread 211 formed on a top end of the mounting tube 21 and detachably engaging the internal thread 142 of the driven member 14 of the body 10.

The spiral pushing rod assembly 22 is mounted in the mounting tube 21, is mounted detachably in the tail end 158 of the mandrel 15, is capable of driving the mandrel 15, the bushing 16 and the threaded shaft 17, 17A to rotate, and has a tube body 221, a spiral rod 222, a connecting head 223, a pin 224 and a bearing 225.

The tube body 221 is hollow and is mounted in the mounting tube 21.

The spiral rod 222 is mounted in the tube body 221 and has an insertion plate 2221 and a pin hole 2222. The insertion plate 2221 is formed on a head end 2227 end of the spiral rod 222. The pin hole 2222 is defined transversely through the insertion plate 2221.

The connecting head 223 is mounted rotatably in the mounting tube 21 above the spiral rod 222 and has a protrusion 2231, an assembling hole 2232 and an insertion slot 2233. The protrusion 2231 is polygonal, is formed on a head end 2238 end of the connecting head 223 and is mounted detachably in the recess 152 of the mandrel 15. The assembling hole 2232 is defined radially through the connecting head 223. The insertion slot 2233 is defined in a bottom end of the connecting head 223, communicates with the assembling hole 2232 and receives the insertion plate 2221 of the spiral rod 222.

The pin 224 is mounted through the assembling hole 2232 and the pin hole 2222 of the spiral rod 222 to connect the connecting head 223 and the spiral rod 222.

The bearing 225 is mounted securely in the mounting tube 21 and is mounted around the connecting head 223. Other components of the push-and-pull mandrel-driving device 20 are conventional, so that related descriptions are omitted.

Pushing and pulling the tube body 221 of the spiral pushing rod assembly 22 relative to the mounting tube 21 drive the mandrel 15, the bushing 16 and the threaded shaft 17, 17A to rotate to be screwed into/onto or out of the rivet nut 18 or the rivet bolt 18A.

Figure 7:
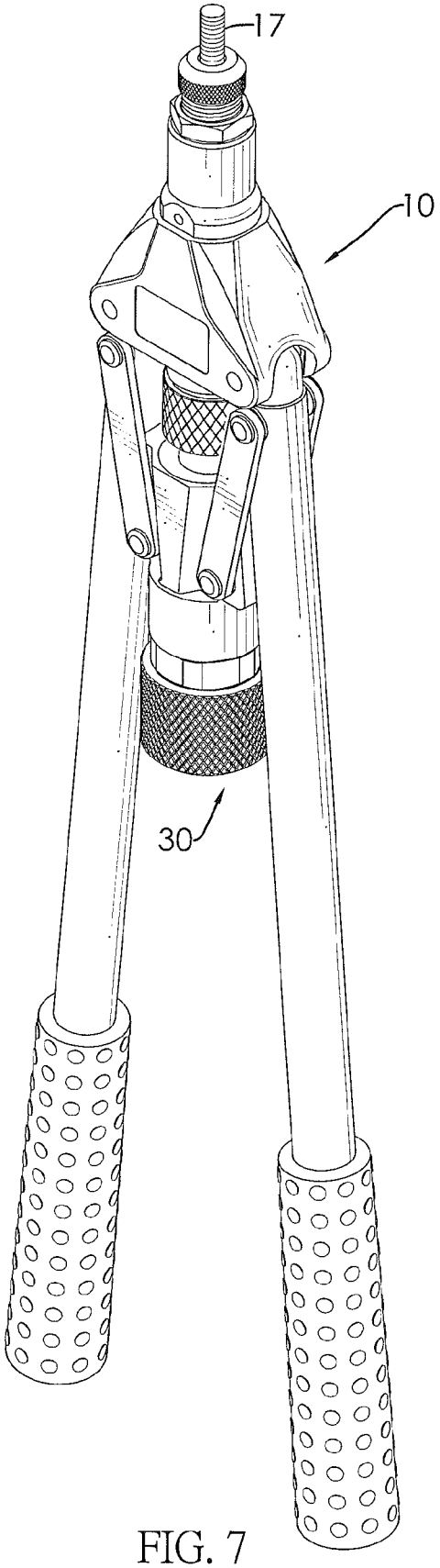
FIG. 7 is a perspective view of a second embodiment of the hand-held rivet nut tool with a replaceable rotational mandrel-driving device in accordance with the present invention.
Figure 8:
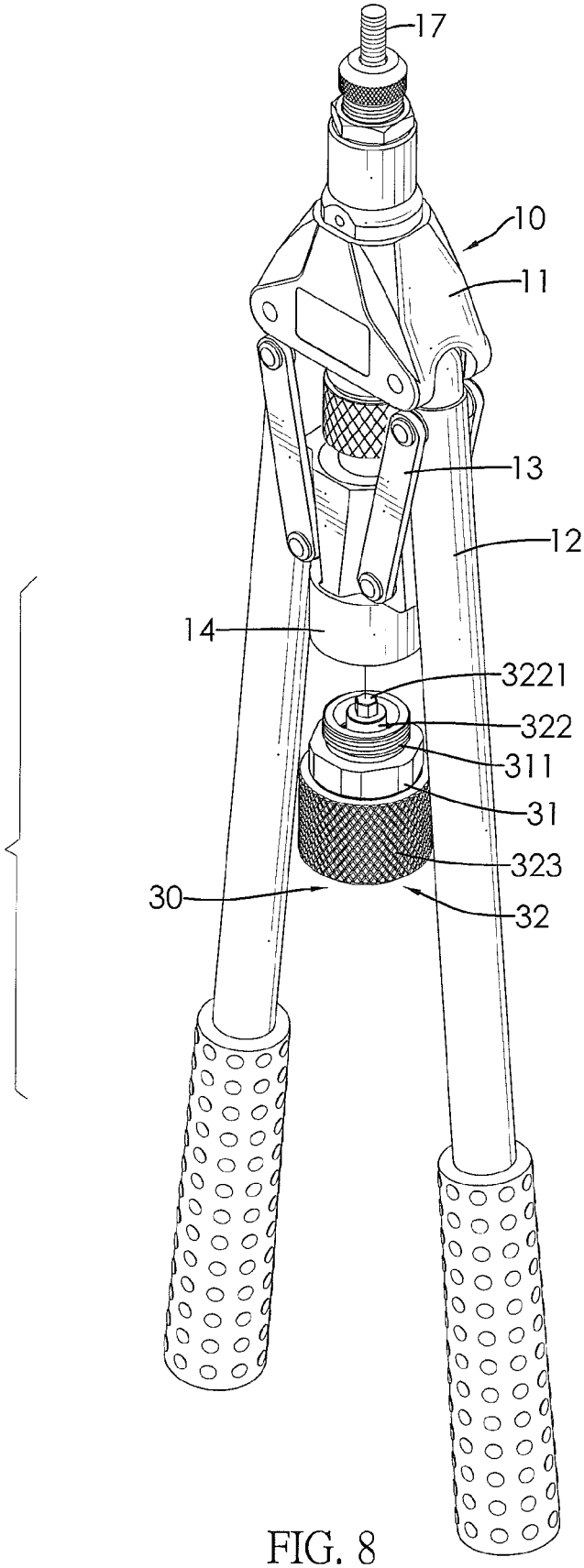
FIG. 8 is a partially exploded perspective view of the hand-held rivet nut tool in FIG. 7.
Figure 9:
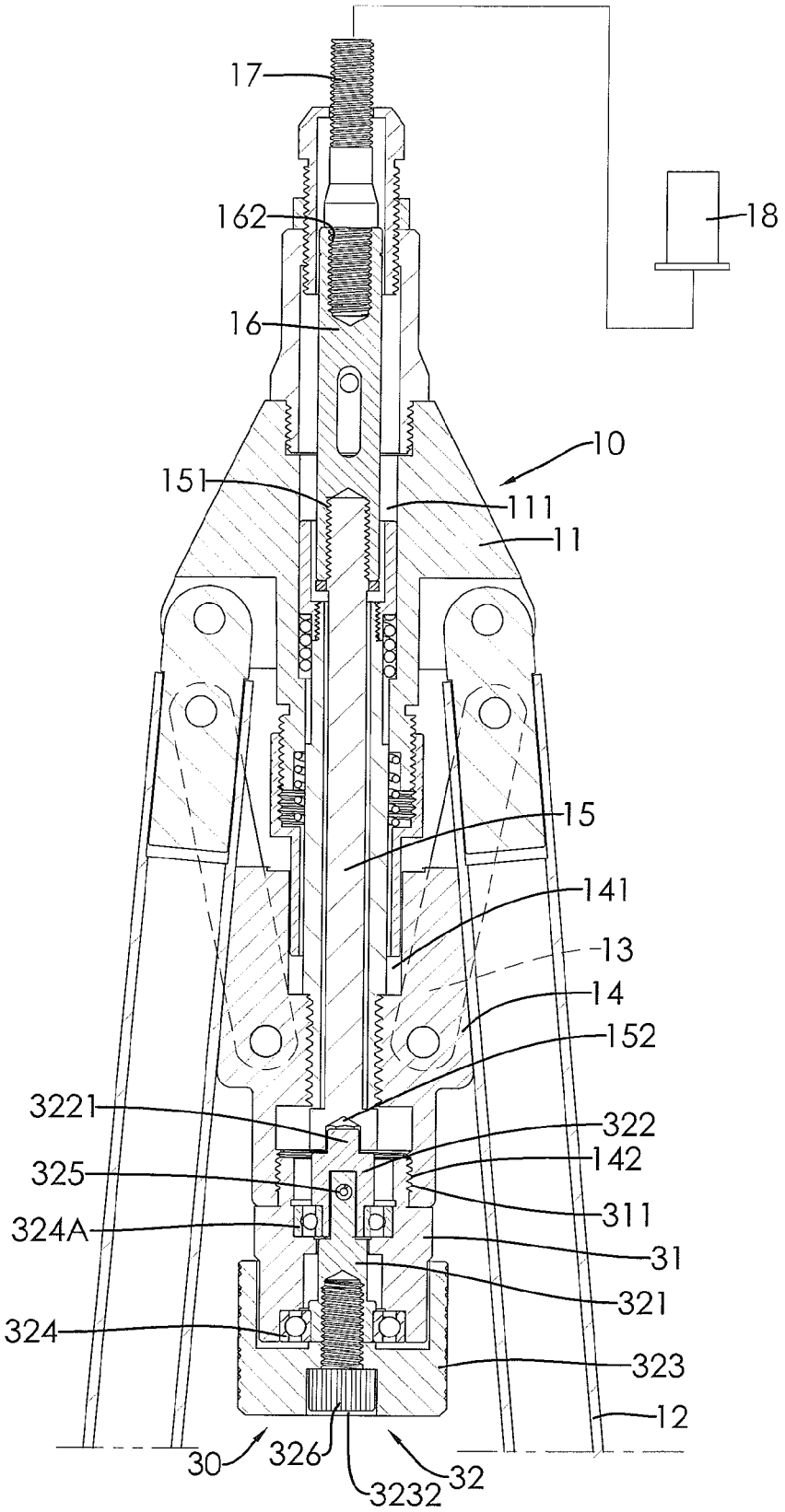
FIG. 9 is a cross sectional side view of the hand-held rivet nut tool in FIG. 7 with a male threaded shaft corresponding to a rivet nut.
Figure 10:
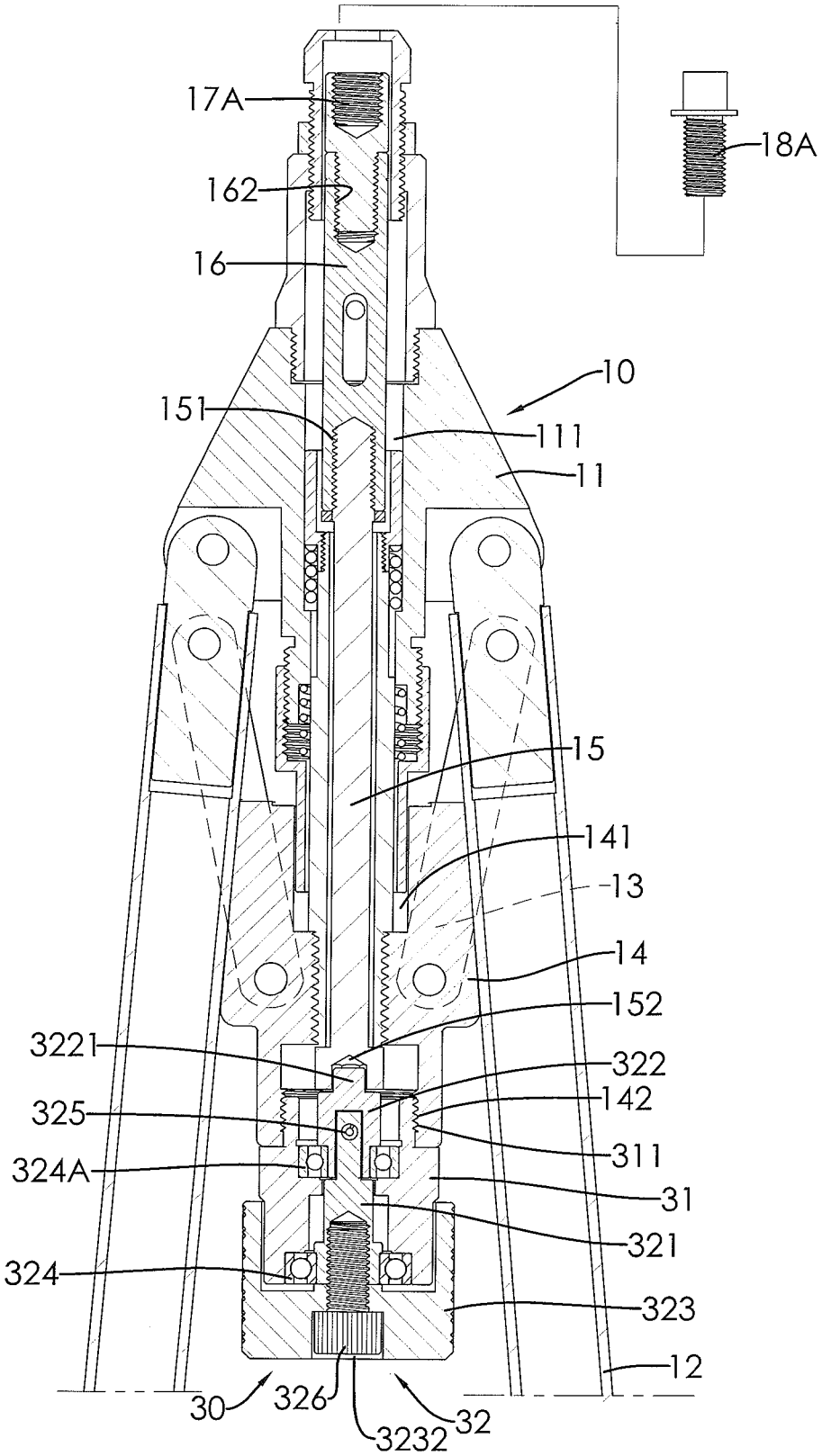
FIG. 10 is an operational cross sectional side view of the hand-held rivet nut tool in FIG. 7 with a female threaded shaft corresponding to a rivet bolt.
Figure 11:
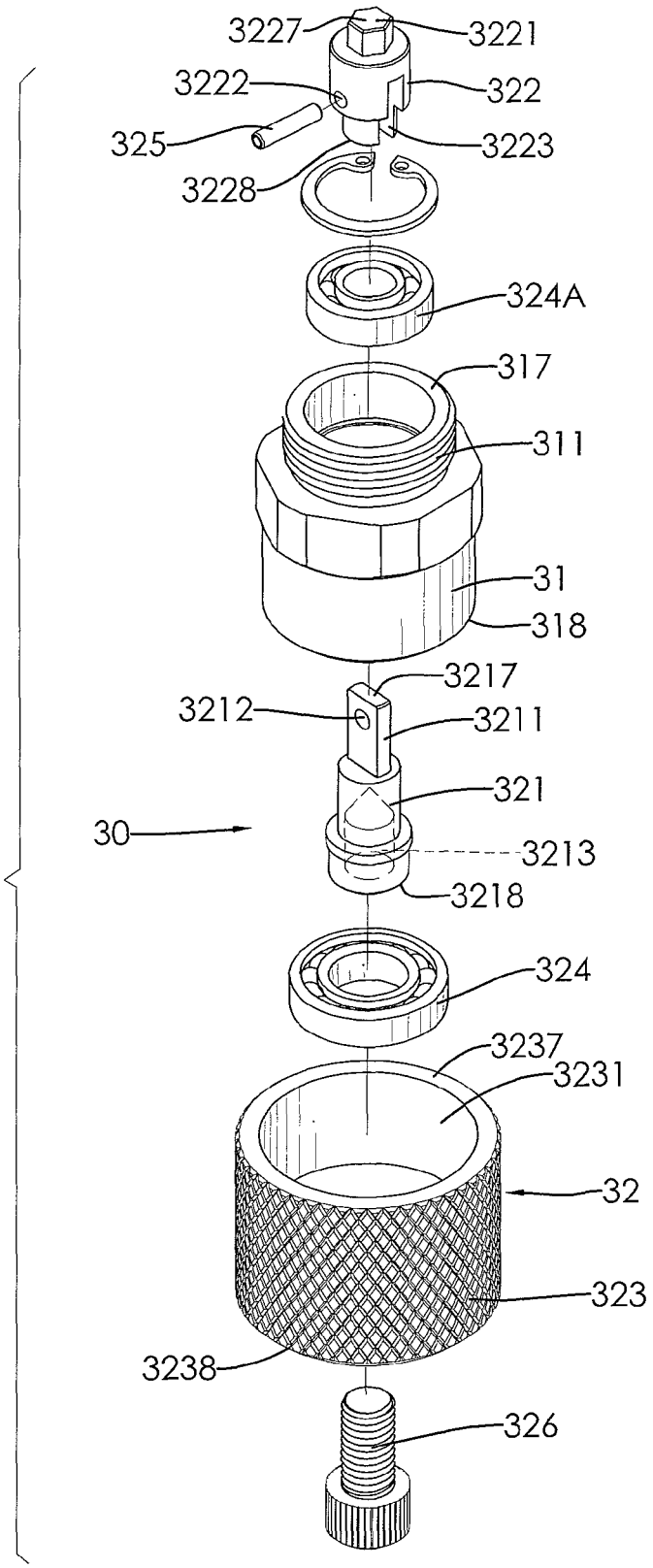
FIG. 11 is an exploded perspective view of the rotational mandrel-driving device of the hand-held rivet nut tool in FIG. 7.
Figure 12:
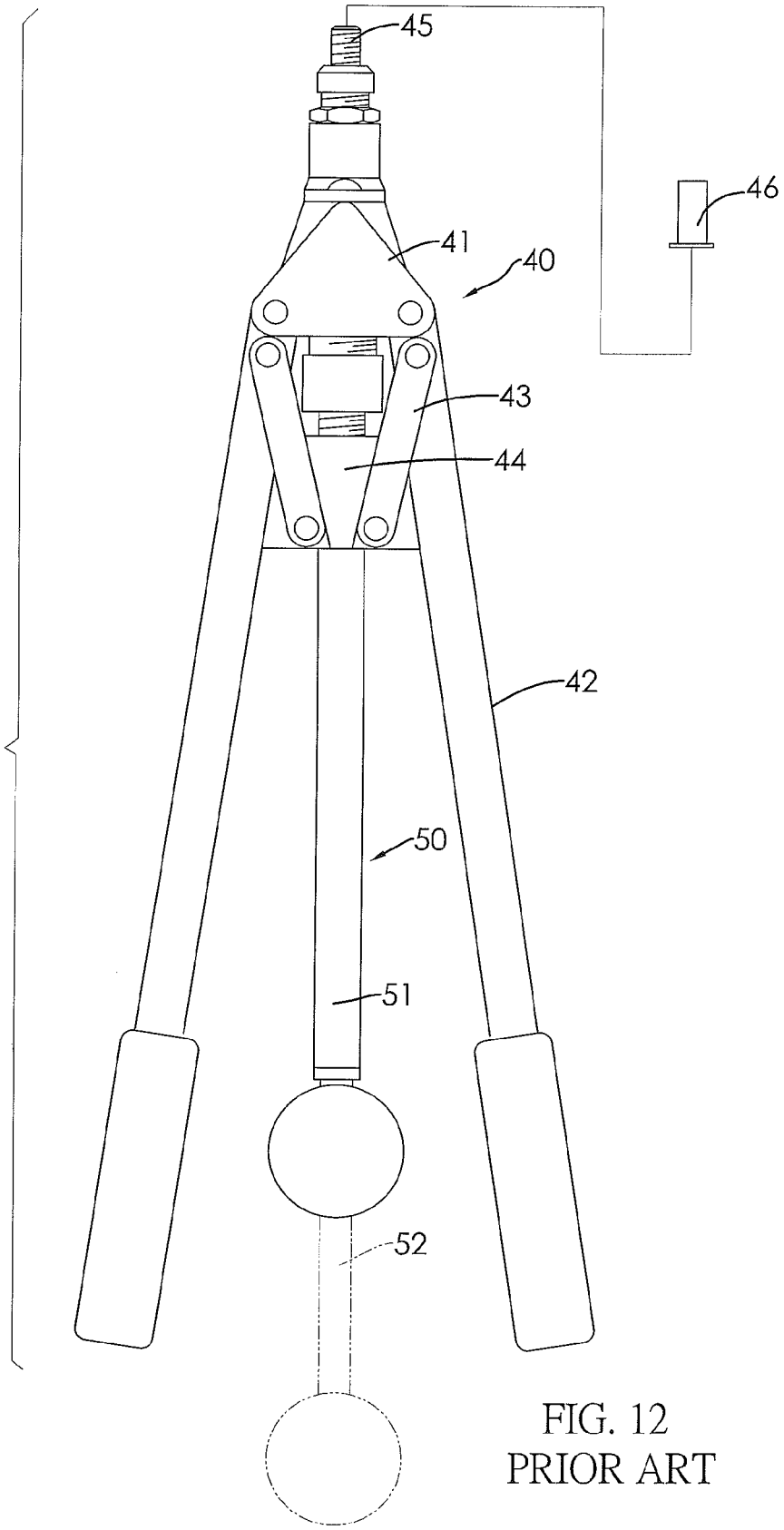
FIG. 12 PRIOR ART
FIG. 12 is a front view of a conventional rivet nut tool in accordance with the prior art.

With further reference to FIG. 7, a second embodiment of the hand-held rivet nut tool in accordance with present invention comprises a body 10 and a rotational mandrel-driving device 30.

The body 10 is identical to that in the first embodiment.

With further reference to FIGS. 8 to 11, the rotational mandrel-driving device 30 is mounted detachably on the driven member 14, is capable of driving the mandrel 15, the bushing 16 and the threaded shaft 17, 17A to rotate and has a mounting cylinder 31 and a rotation assembly 32.

The mounting cylinder 31 is hollow, is mounted detachably on the driven member 14 and has an outer thread 311 formed on the mounting cylinder 31 adjacent to a head end 317 end of the mounting cylinder 31 and detachably engaging the internal thread 142 of the driven member 14 of the body 10.

The rotation assembly 32 is mounted on the mounting cylinder 31 and has a pintle 321, a connecting rod 322, a pin 325, two bearings 324, 324A, a knob 323, and a securing bolt 326.

The pintle 321 is mounted rotatably in the mounting cylinder 31 and has an insertion plate 3211, a pin hole 3212 and a screwing hole 3213. The insertion plate 3211 is formed on a head end 3217 end of the pintle 321. The pin hole 3212 is defined transversely through the pintle 321. The screwing hole 3213 is defined in a tail end 3218 end of the pintle 321.

The connecting rod 322 is mounted on the pintle 321 and has a protrusion 3221, an assembling hole 3222 and an insertion slot 3223. The protrusion 3221 is polygonal, is formed on a head end 3227 end of the connecting rod 322 and is mounted detachably in the recess 152 of the mandrel 15. The assembling hole 3222 is defined radially through the connecting rod 322. The insertion slot 3223 is defined in a tail end 3238 end of the connecting rod 322 and communicates with the assembling hole 3222.

The pin 325 is mounted through the pin hole 3212 of the pintle 321 and the assembling hole 3222 of the connecting rod 322 to connect the pintle 321 and the connecting rod 322.

One bearing 324 is mounted securely in the mounting cylinder 31 and is mounted around the pintle 321. The other bearing 324A is mounted securely in the mounting cylinder 31 and is mounted around the connecting rod 322.

The knob 323 is mounted rotatably around a tail end 318 of the mounting cylinder 31, is mounted securely on the tail end 3218 of the pintle 321 and has a cavity 3231 and a through hole 3232. The cavity 3231 is defined in a head end 318 of the knob 323 and rotatably receives the bottom end of the mounting cylinder 31. The through hole 3232 is defined through a tail end 3238 of the knob 323 and communicates with the cavity 3231.

The securing bolt 326 is mounted through the through hole 3232 of the knob 323 into the cavity 3231 and is mounted securely in the screwing hole 3213 of the pintle 321.

Rotating the knob 323 of the rotational mandrel-driving device 30 drives the mandrel 15, the bushing 16 and the threaded shaft 17, 17A to rotate to be screwed into/onto or out of the rivet nut 18 or rivet bolt 18A.

The push-and-pull mandrel-driving device 20 and the rotational mandrel-driving device 30 are alternatively mounted detachably on the body 10 of the hand-held rivet nut tool and can be replaced with each other. A user may choose either the push-and-pull mandrel-driving device 20 or the rotational mandrel-driving device 30 according to different working spaces or personal practices. Therefore, the applicability of the hand-held rivet nut tool is improved.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A hand-held rivet nut tool comprising:
- a body having:
  - a base having a through hole defined through the base;
  - two handles connected pivotally and respectively to two opposite sides of the base;
  - two pairs of links connected pivotally and respectively to the two handles;
  - a driven member connected pivotally to the two pairs of the links, located under the base and having an aperture defined through the driven member and corresponding to the through hole of the base;
  - a mandrel mounted rotatably through the aperture of the driven member and the through hole of the base;
  - a bushing mounted on a head end of the mandrel; and
  - a threaded shaft mounted on a head end of the bushing; and
- a push-and-pull mandrel-driving device mounted detachably on the driven member and having:
  - a mounting tube being hollow and mounted detachably on the driven member; and
  - a spiral pushing rod assembly mounted in the mounting tube, mounted detachably in a tail end of the mandrel, being capable of driving the mandrel, the bushing and the threaded shaft to rotate and having:
    - a tube body being hollow and mounted in the mounting tube; and
    - a spiral rod mounted in the tube body, wherein pushing and pulling the tube body of the spiral pushing rod assembly relative to the mounting tube drive the mandrel, the bushing and the threaded shaft to rotate.

2. The hand-held rivet nut tool as claimed in claim 1, wherein:
- the aperture of the driven member has an internal thread formed on an inner surface of the aperture adjacent to a tail end of the driven member; and
- the mounting tube of the push-and-pull mandrel-driving device has an outer thread formed on a head end of the mounting tube and detachably engaging the internal thread of the driven member of the body.

3. The hand-held rivet nut tool as claimed in claim 1, wherein:
- the mandrel further has a recess defined in the tail end of the mandrel; and
- the spiral pushing rod assembly has a protrusion formed above the spiral rod and mounted detachably in the recess of the mandrel.

4. The hand-held rivet nut tool as claimed in claim 2, wherein:
- the mandrel further has a recess defined in the tail end of the mandrel; and
- the spiral pushing rod assembly has a protrusion formed above the spiral rod and mounted detachably in the recess of the mandrel.

5. The hand-held rivet nut tool as claimed in claim 3, wherein:
- the recess of the mandrel is polygonal; and
- the protrusion of the spiral pushing rod assembly is polygonal.

6. The hand-held rivet nut tool as claimed in claim 4, wherein:
- the recess of the mandrel is polygonal; and
- the protrusion of the spiral pushing rod assembly is polygonal.

7. The hand-held rivet nut tool as claimed in claim 5, wherein:
- the spiral rod of the spiral pushing rod assembly has:
  - an insertion plate formed on a head end of the spiral rod; and
  - a pin hole defined transversely through the insertion plate; and
- the spiral pushing rod assembly further has:
  - a connecting head mounted rotatably in the mounting tube above the spiral rod and having:
    - the protrusion formed on a head end of the connecting head;
    - an assembling hole defined radially through the connecting head; and
    - an insertion slot defined in a tail end of the connecting head, communicating with the assembling hole and receiving the insertion plate of the spiral rod;
  - a pin mounted through the assembling hole and the pin hole of the spiral rod to connect the connecting head and the spiral rod; and
  - a bearing mounted securely in the mounting tube and mounted around the connecting head.

8. The hand-held rivet nut tool as claimed in claim 6, wherein:
- the spiral rod of the spiral pushing rod assembly has:
  - an insertion plate formed on a head end of the spiral rod; and
  - a pin hole defined transversely through the insertion plate; and
- the spiral pushing rod assembly further has:
  - a connecting head mounted rotatably in the mounting tube above the spiral rod and having:
    - the protrusion formed on a head end of the connecting head;
    - an assembling hole defined radially through the connecting head; and
    - an insertion slot defined in a tail end of the connecting head, communicating with the assembling hole and receiving the insertion plate of the spiral rod;
  - a pin mounted through the assembling hole and the pin hole of the spiral rod to connect the connecting head and the spiral rod; and
  - a bearing mounted securely in the mounting tube and mounted around the connecting head.

9. A hand-held rivet nut tool comprising:
- a body having:
  - a base having a through hole defined through the base;

two handles connected pivotally and respectively to two opposite sides of the base;

two pairs of links connected pivotally and respectively to the two handles;

a driven member connected pivotally to the two pairs of the links, located under the base and having an aperture defined through the driven member and corresponding to the through hole of the base;

a mandrel mounted rotatably through the aperture of the driven member and the through hole of the base;

a bushing mounted on a head end of the mandrel; and a threaded shaft mounted on a head end of the bushing; and a rotational mandrel-driving device mounted detachably on the driven member, mounted detachably in a tail end of the mandrel, being capable of driving the mandrel, the bushing and the threaded shaft to rotate and having:

a mounting cylinder mounted detachably on the driven member; and a rotation assembly mounted on the mounting cylinder and having:

a pintle mounted rotatably in the mounting cylinder; and a knob mounted securely on a tail end of the pintle, wherein rotating the knob of the rotational mandrel-driving device drives the mandrel, the bushing and the threaded shaft to rotate.

10. The hand-held rivet nut tool as claimed in claim 9, wherein:

the aperture of the driven member has an internal thread formed on an inner surface of the aperture adjacent to a tail end of the driven member; and the mounting cylinder has an outer thread formed on the mounting cylinder adjacent to a head end of the mounting cylinder and detachably engaging the internal thread of the driven member of the body.

11. The hand-held rivet nut tool as claimed in claim 9, wherein:

the mandrel further has a recess defined in a tail end of the mandrel; and the rotation assembly further has a protrusion formed above the pintle and mounted detachably in the recess of the mandrel.

12. The hand-held rivet nut tool as claimed in claim 10, wherein:

the mandrel further has a recess defined in a tail end of the mandrel; and the rotation assembly further has a protrusion formed above the pintle and mounted detachably in the recess of the mandrel.

13. The hand-held rivet nut tool as claimed in claim 11, wherein:

the recess of the mandrel is polygonal; and the protrusion of the rotation assembly is polygonal.

14. The hand-held rivet nut tool as claimed in claim 12, wherein:

the recess of the mandrel is polygonal; and the protrusion of the rotation assembly is polygonal.

15. The hand-held rivet nut tool as claimed in claim 13, wherein:

the pintle of the rotation assembly has:

an insertion plate formed on a head end of the pintle; and a pin hole defined transversely through the pintle;

the rotation assembly further has:

a connecting rod mounted on the pintle and having:

the protrusion formed on a head end of the connecting rod;

an assembling hole defined radially through the connecting rod; and an insertion slot defined in a tail end of the connecting rod, communicating with the assembling hole and receiving the insertion plate of the pintle;

a pin mounted through the pin hole of the pintle and the assembling hole of the connecting rod to connect the pintle and the connecting rod; and two bearings, one bearing mounted securely in the mounting cylinder and mounted around the pintle, and the other bearing mounted securely in the mounting cylinder and mounted around the connecting rod.

16. The hand-held rivet nut tool as claimed in claim 14, wherein:

the pintle of the rotation assembly has:

an insertion plate formed on a head end of the pintle; and a pin hole defined transversely through the pintle;

the rotation assembly further has:

a connecting rod mounted on the pintle and having:

the protrusion formed on a head end of the connecting rod;

an assembling hole defined radially through the connecting rod; and an insertion slot defined in a tail end of the connecting rod, communicating with the assembling hole and receiving the insertion plate of the pintle;

a pin mounted through the pin hole of the pintle and the assembling hole of the connecting rod to connect the pintle and the connecting rod; and two bearings, one bearing mounted securely in the mounting cylinder and mounted around the pintle, and the other bearing mounted securely in the mounting cylinder and mounted around the connecting rod.

17. The hand-held rivet nut tool as claimed in claim 15, wherein:

the pintle further has a screwing hole defined in the tail end of the pintle;

the knob has:

a cavity defined in a head end of the knob and rotatably receiving a tail end of the mounting cylinder; and a through hole defined through a tail end of the knob and communicating with the cavity; and a securing bolt is mounted through the through hole of the knob into the cavity and is mounted securely in the screwing hole of the pintle.

18. The hand-held rivet nut tool as claimed in claim 16, wherein:

the pintle further has a screwing hole defined in the tail end of the pintle;

the knob has:

a cavity defined in a head end of the knob and rotatably receiving a tail end of the mounting cylinder; and a through hole defined through a tail end of the knob and communicating with the cavity; and a securing bolt is mounted through the through hole of the knob into the cavity and is mounted securely in the screwing hole of the pintle.

* * * * *